US012704321B2

(12) United States Patent
Modi et al.

(10) Patent No.: US 12,704,321 B2
(45) Date of Patent: Aug. 11, 2026

(54) COOLING APPLIANCE INCLUDING AN AIR DUCT ASSEMBLY WITH A SENSING ELEMENT

(71) Applicant: BSH Hausgeräte GmbH, Munich (DE)

(72) Inventors: Ashish Modi, Istanbul (TR); Veysel Tekce, Tekirdag (TR); Necati Bora Gürel, Augsburg (DE)

(73) Assignee: BSH Hausgeräte GmbH, Munich (DE)

( * ) Notice: Subject to any disclaimer, the term of this patent is extended or adjusted under 35 U.S.C. 154(b) by 404 days.

(21) Appl. No.: 18/350,295

(22) Filed: Jul. 11, 2023

(65) Prior Publication Data

US 2024/0093932 A1 Mar. 21, 2024

(51) Int. Cl.
*F25D 29/00* (2006.01)
*F25D 17/06* (2006.01)

(52) U.S. Cl.
CPC ..... *F25D 29/005* (2013.01); *F25D 17/065* (2013.01); *F25D 2317/0672* (2013.01); *F25D 2700/12* (2013.01)

(58) Field of Classification Search
CPC .. F25D 17/062; F25D 17/065; F25D 2700/12; F25D 29/005
See application file for complete search history.

(56) References Cited

U.S. PATENT DOCUMENTS 6,044,654 A * 4/2000 Igari ..... F25D 17/065 62/131
9,175,898 B2 * 11/2015 Chae ..... F25D 17/065
9,382,909 B2 * 7/2016 Hwang ..... F04D 27/005
10,317,123 B1 * 6/2019 Wohlers ..... F25D 29/00
10,663,206 B2 * 5/2020 Sigl ..... F25C 5/046
10,962,274 B2 * 3/2021 Shin ..... F25D 17/065
11,015,858 B2 * 5/2021 Lee ..... F25D 17/045
11,828,518 B2 * 11/2023 Gary ..... F25D 17/065
12,078,404 B2 * 9/2024 Leidens ..... F25D 21/04
12,305,905 B2 * 5/2025 Ronsen ..... F25D 11/02
2004/0016259 A1 * 1/2004 Cho ..... F25D 17/065 62/275
2014/0060106 A1 * 3/2014 Van Meter ..... F25C 1/04 62/340

(Continued)

FOREIGN PATENT DOCUMENTS

CN 201926510 U 8/2011
CN 105928315 B 1/2019

(Continued)

*Primary Examiner* — Filip Zec
(74) *Attorney, Agent, or Firm* — Laurence A. Greenberg; Werner H. Stemer; Ralph E. Locher

(57) ABSTRACT

A cooling appliance includes a storage compartment for receiving goods to be cooled, and an air duct assembly in fluid communication with the storage compartment. The air duct assembly includes at least one air duct for suctioning the cool air from the storage compartment. A sensing element senses the temperature of the cool air of the storage compartment. The air duct has a first duct housing part with an air suctioning entrance opening through which the cool air enters into the air duct, and an external second duct housing part on which the sensing element is provided. The external second duct housing part is configured to be selectively connected to the first duct housing part.

16 Claims, 8 Drawing Sheets

(56) References Cited

U.S. PATENT DOCUMENTS

| | | | | |
|---|---|---|---|---|
| 2015/0323240 | A1* | 11/2015 | Klingshirn | F25D 17/065<br>62/186 |
| 2018/0328641 | A1* | 11/2018 | Lee | F25D 17/067 |
| 2018/0347887 | A1* | 12/2018 | Kenneally | F25D 3/125 |
| 2019/0072317 | A1* | 3/2019 | Baysal | F25D 23/04 |
| 2019/0301786 | A1* | 10/2019 | Lee | F25D 17/08 |
| 2021/0172670 | A1* | 6/2021 | Lee | F25C 1/00 |

FOREIGN PATENT DOCUMENTS

| | | | |
|---|---|---|---|
| CN | 211347124 | U | 8/2020 |
| CN | 113701423 | A | 11/2021 |

* cited by examiner

COOLING APPLIANCE INCLUDING AN AIR DUCT ASSEMBLY WITH A SENSING ELEMENT

CROSS-REFERENCE TO RELATED APPLICATION

This application claims the priority, under 35 U.S.C. § 119, of Turkish Patent Application TR 2022/014293, filed Sep. 15, 2022; the prior application is herewith incorporated by reference in its entirety.

FIELD AND BACKGROUND OF THE INVENTION

The present invention relates to a cooling appliance including a storage compartment for receiving goods to be cooled, an air duct assembly in fluid communication with the storage compartment, the air duct assembly having at least one air duct for suctioning cool air from the storage compartment, and a sensing element for sensing a temperature of the cool air of the storage compartment.

DESCRIPTION OF THE RELATED ART

Cooling appliances include sensing elements, e.g. temperature sensing elements, for sensing the temperature of the cooling air which is suctioned from the storage compartment. Defining the location of the sensing element and mounting the sensing element at the defined location in a simple and safe manner, are important issues for cooling appliances.

In the prior art, Chinese Utility Model CN201926510 U discloses a temperature sensing component box which includes a box body and a box cover which can form a buckling seal, wherein a notch used for fixing the temperature sensing component, a wire clip used for fixing a wire harness and a wire harness threading hole are disposed in the box body. The temperature sensing component box is distinguished in that a convex rib which ensures that the temperature sensing element is kept at a certain distance away from the top part of the box cover is disposed on the inner surface of the box cover, and a through hole is disposed in the box cover. The temperature sensing component box can be disposed at any position on a rear back plate or a top frame of a refrigerator, a freezer, a display cabinet and other household electric appliances. In the above-described positions, the temperature sensing component disposed in the box body can sense the environmental temperature sensitively. A temperature compensation heater can be automatically controlled to operate at a low ambient temperature and meanwhile, the temperature sensing component can be convenient and can be rapidly maintained or replaced when a failure occurs.

The present invention provides an additional improvement, an additional advantage or an alternative to the prior art.

SUMMARY OF THE INVENTION

It is accordingly an object of the invention to provide a cooling appliance including an air duct assembly with a sensing element, which overcomes the hereinafore-mentioned disadvantages of the heretofore-known appliances of this general type and which has a simple and safe air duct assembly whereon the sensing element is provided.

With the foregoing and other objects in view there is provided, in accordance with the invention, a cooling appliance, comprising a storage compartment for receiving goods to be cooled, an air duct assembly in fluid communication with the storage compartment, the air duct assembly including at least one air duct for suctioning the cool air from the storage compartment, and a sensing element for sensing a temperature of the cool air of the storage compartment. The air duct is configured to include a first duct housing part having an air suctioning entrance opening through which the cool air enters into the air duct, and an external second duct housing part configured to be selectively connected to the first duct housing part and on which the sensing element is provided. Thus, the external second housing part whereon the sensing element is provided, can be prepared separately in a simple manner and then, selectively connected to the first housing part. Such an arrangement reduces complexity and labor costs.

In this case, the sensing element can be any kind of element sensing a value of the cool air, such as a temperature sensing element sensing the temperature of the cool air.

In a possible embodiment of the invention, the second duct housing part defines a lateral wall of the substantially box-shaped first duct housing part, when the second duct housing part is connected to the first duct housing part. Thus, the sensing element, e.g. the temperature sensing element, senses the temperature of the cool air inside the air duct in a safe manner.

In a possible embodiment of the invention, the lateral wall is an upper wall of the substantially box-shaped first duct housing part, which is in a plane perpendicular to the air suctioning entrance opening. Thus, the sensing element, e.g. the temperature sensing element, senses the temperature of the cool air inside the air duct in a safe manner.

In a possible embodiment of the invention, the second duct housing part is configured to hold the sensing element at a lower side of the second duct housing part facing inside the first duct housing part. Thus, the sensing element senses a value of the cool air, e.g. the temperature of the cool air, in a safe manner.

In a possible embodiment of the invention, the duct housing parts are configured to be connected to each other by a sliding movement of the second duct housing part towards the first duct housing part. Thus, easy-to-assemble air duct assembly is provided.

In a possible embodiment of the invention, the first duct housing part includes mutual guiding grooves for guiding corresponding edge portions of the second duct housing part. Thus, easy-to-assemble air duct assembly is provided.

In a possible embodiment of the invention, each of the guiding grooves are defined with a first wall, and a second wall spaced apart from the first wall. Thus, a leak-proof air-duct assembly having a sensing element is provided in a simple way. The leak-proof structure is provided between the duct housing parts where the guiding grooves are provided.

In a possible embodiment of the invention, the second duct housing part includes at least one engagement member for engaging with the corresponding engagement members of the first duct housing part, when the second duct housing part is connected to the first duct housing part. Thus, the duct housing parts can be connected to each other in a simple manner.

In a possible embodiment of the invention, the second duct housing part includes two mutual engagement members for engaging with two corresponding engagement members of the first duct housing part. Thus, the connection between the duct housing parts is improved.

In a possible embodiment of the invention, the second duct housing part includes mutual wall receiving portions which at least partially receive the corresponding sidewalls of the first duct housing part, when the second duct housing part is connected to the first duct housing part. Thus, the leak-proof structure is provided between the duct housing parts where the wall receiving portions are provided.

In a possible embodiment of the invention, the second duct housing part includes a sensing element holding chamber provided at the lower side of the second duct housing part so as to hold the sensing element in a tight-fit manner. Thus, the second duct housing part holds the sensing element in a safe manner.

In a possible embodiment of the invention, the second duct housing part includes a cable guiding groove shaped and sized with respect to a shape and pathway of a cable of the sensing element, and provided at the lower side of the second duct housing part. Thus, holding the wire harness of the sensing element is ensured.

In a possible embodiment of the invention, the second duct housing part includes at least a pair of cable holding members for holding the cable at least partially inside the cable guiding groove. Thus, holding of the wire harness of the sensing element is improved.

In a possible embodiment of the invention, the second duct housing part includes a cable guiding hole provided at an end of the cable guiding groove, and through which the cable can pass. Thus, an electrical connection of the sensing element outside the air duct assembly can be provided.

In a possible embodiment of the invention, a circumferential wall is provided on a circumference of the cable guiding hole at an upper side of the second duct housing part which is opposite to the lower side, so as to extend away from the second duct housing part, and a gap covering member, preferably a foam member, is provided so as to cover a gap between the cable and the circumferential wall. Thus, a leak-proof structure is provided between cable and the cable guiding hole.

In this context, the designations "top," "bottom," "front," "rear," "horizontal," "vertical," "upward," "downward," "inner," "outer," "inward," "outward," etc. indicate positions and orientations for intended use and intended arrangement of the cooling appliance and for a user standing in front of the cooling device in a closed position and viewing in the direction of the device.

Each possible embodiment disclosed in this text can be combined with the other possible embodiments disclosed in this text, if there is not any technical constraint.

The figures, brief explanations of which are provided herein, are solely intended for providing a better understanding of the present invention and are as such not intended to define the scope of protection or the context in which the scope is to be interpreted in the absence of the description.

Other features which are considered as characteristic for the invention are set forth in the appended claims.

Although the invention is illustrated and described herein as embodied in a cooling appliance including an air duct assembly with a sensing element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, the subject matter is explained with reference to examples without forming any restrictive effect, only in order to make the subject more understandable.

Figure 1:
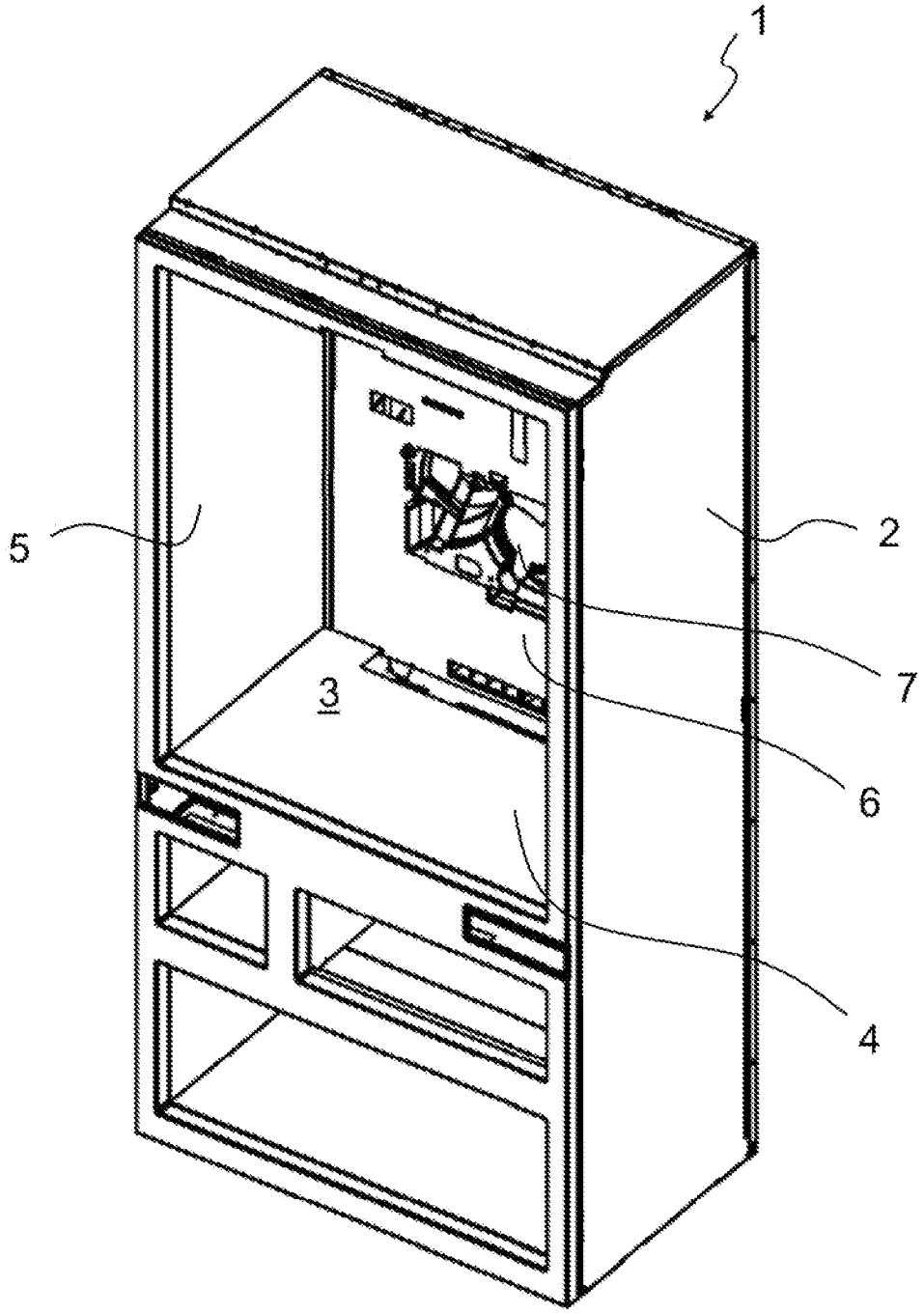
FIG. 1 is a representative, diagrammatic, perspective view of the cooling appliance.

Referring now to the figures of the drawings in detail and first, particularly, to FIG. 1 thereof, there is seen a cooling appliance 1 which includes a body 2, at least one storage compartment 3 surrounded by the body 2 and one or more non-illustrated doors which may shield a front access opening 4 of the storage compartment 3. The storage compartment 3 may include a refrigerator compartment which keeps goods, e.g. food to be cooled, and a freezer compartment, which may keep food frozen. At least one non-illustrated cool air supply device is provided for generating and controlling the cool air. The cool air supply device includes a compressor, a condenser, at least one evaporator, at least one blowing fan and air carrying ducts, which are not shown in the figures. The evaporator may be connected to a refrigerant pipe and a refrigerant may be directed through the refrigerant pipe. The refrigerator compartment may be formed at an upper side of the freezer compartment. The cool air generated by the evaporator may be supplied to the storage compartment, the refrigerator compartment and/or the freezer compartment through the blowing fan. A plurality of non-illustrated cool air ducts are provided in the storage compartment 3 in such a way that cool air is supplied to the storage compartment 3 by operating the blowing fan. There is an inner liner 5 on a side facing the storage compartment 3. The inner liner 5 has a rear wall 6 provided at an opposite side from the front access opening 4. An air duct assembly 7 is positioned behind the rear wall 6 so as to be in fluid communication with the storage compartment 3.

Figure 2:
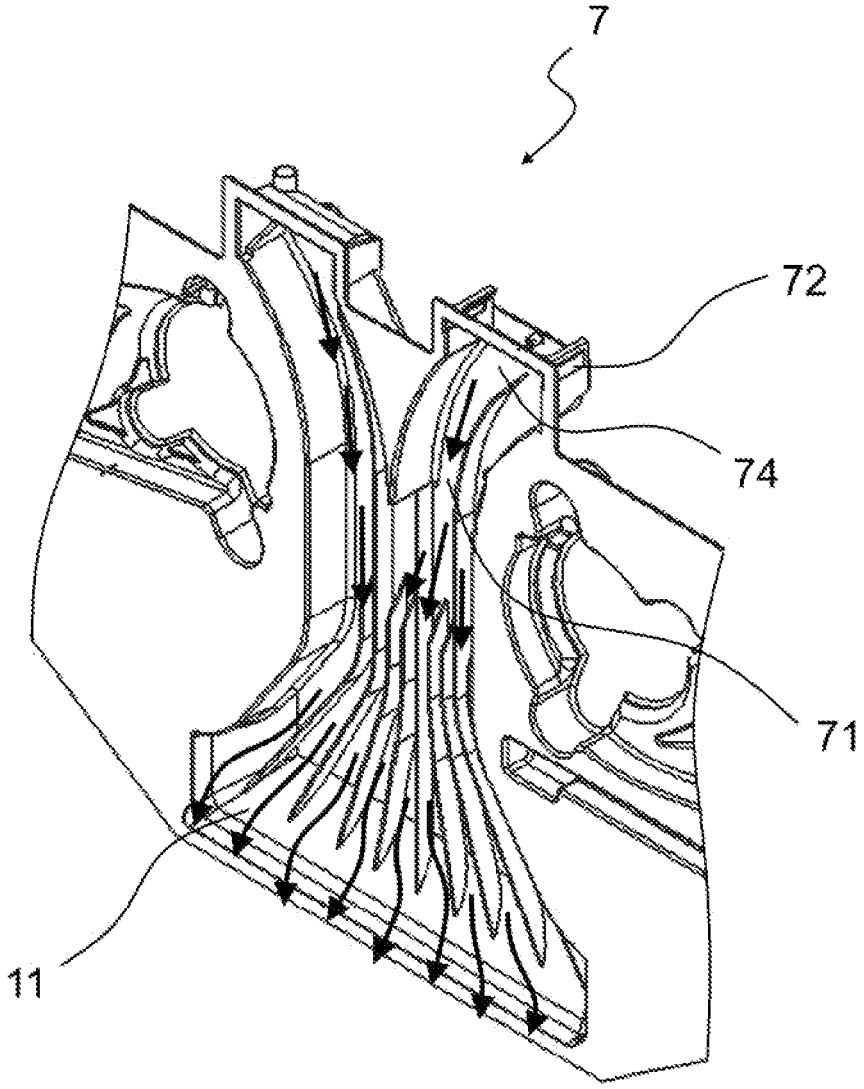
FIG. 2 is a representative, enlarged perspective view of the air duct assembly.
Figure 3:
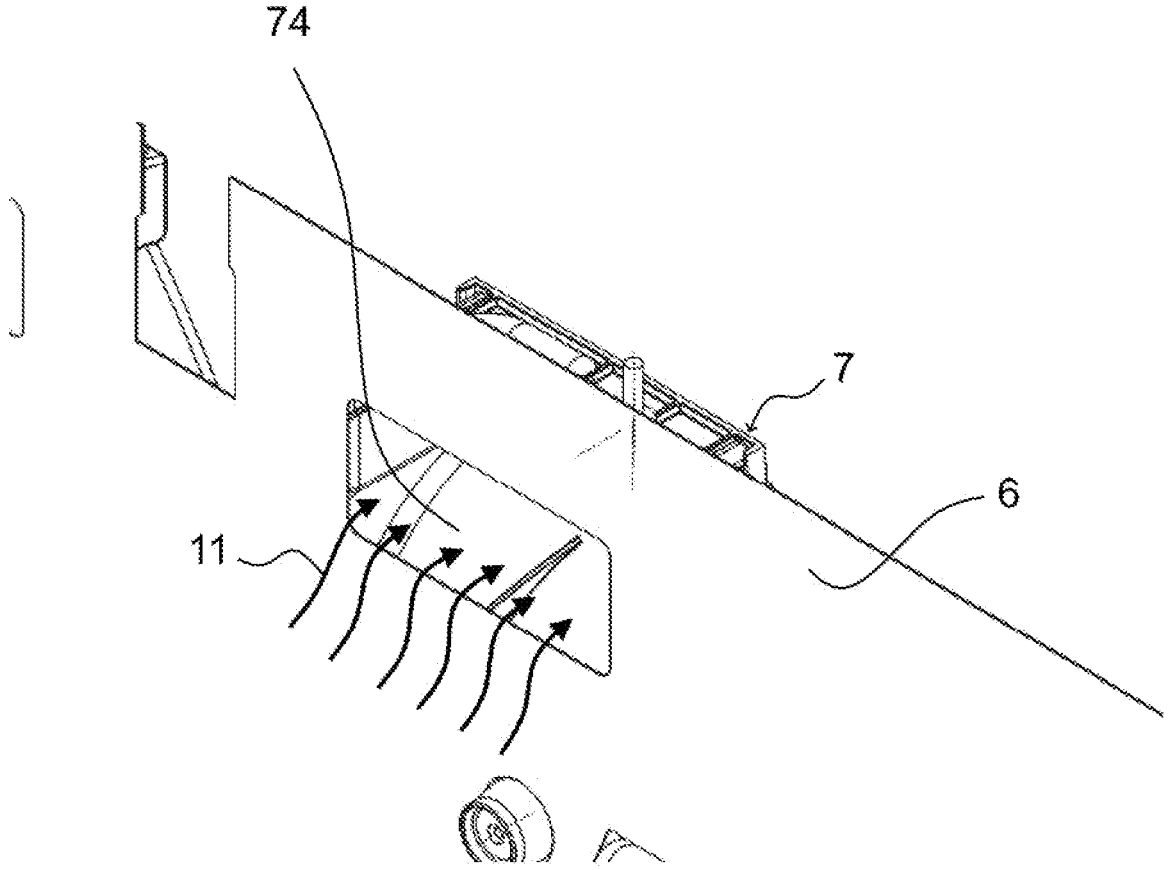
FIG. 3 is a representative, fragmentary, zoomed, perspective view of the rear wall of the cooling appliance where the subject-matter air duct is provided.

As can be seen in FIG. 2, the air duct assembly 7 includes at least one air duct 71 for suctioning cool air 11 from the storage compartment 3. In FIG. 2, the exemplary air duct assembly 7 includes two air ducts. The air duct 71 is configured to have a first duct housing part 72. As can also be seen in FIG. 3, the first duct housing part 72 has an air suctioning entrance opening 74 through which the cool air 11 enters to the air duct 71. Afterwards, the cool air 11 follows the path of the air duct 71 behind the inner liner 5 in order to reach the non-illustrated evaporator not shown.

Figure 4:
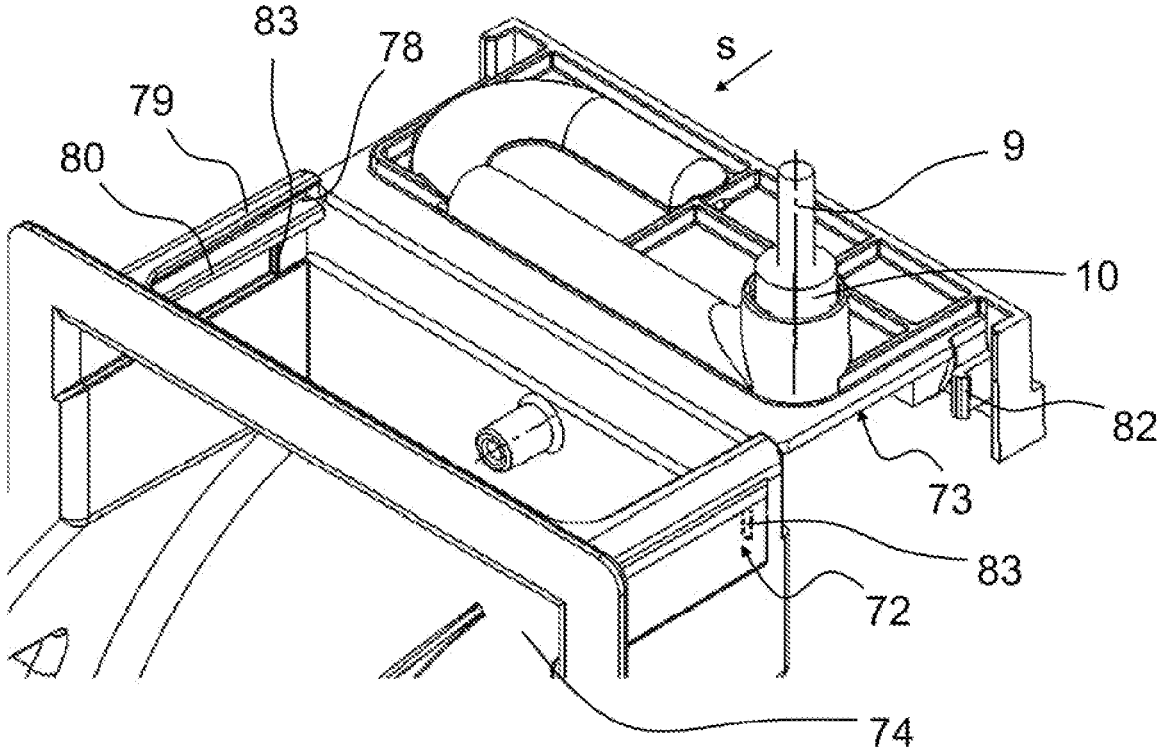
FIG. 4 is a representative, fragmentary, perspective view of the first duct housing part and second duct housing part in a demounted state.
Figure 8:
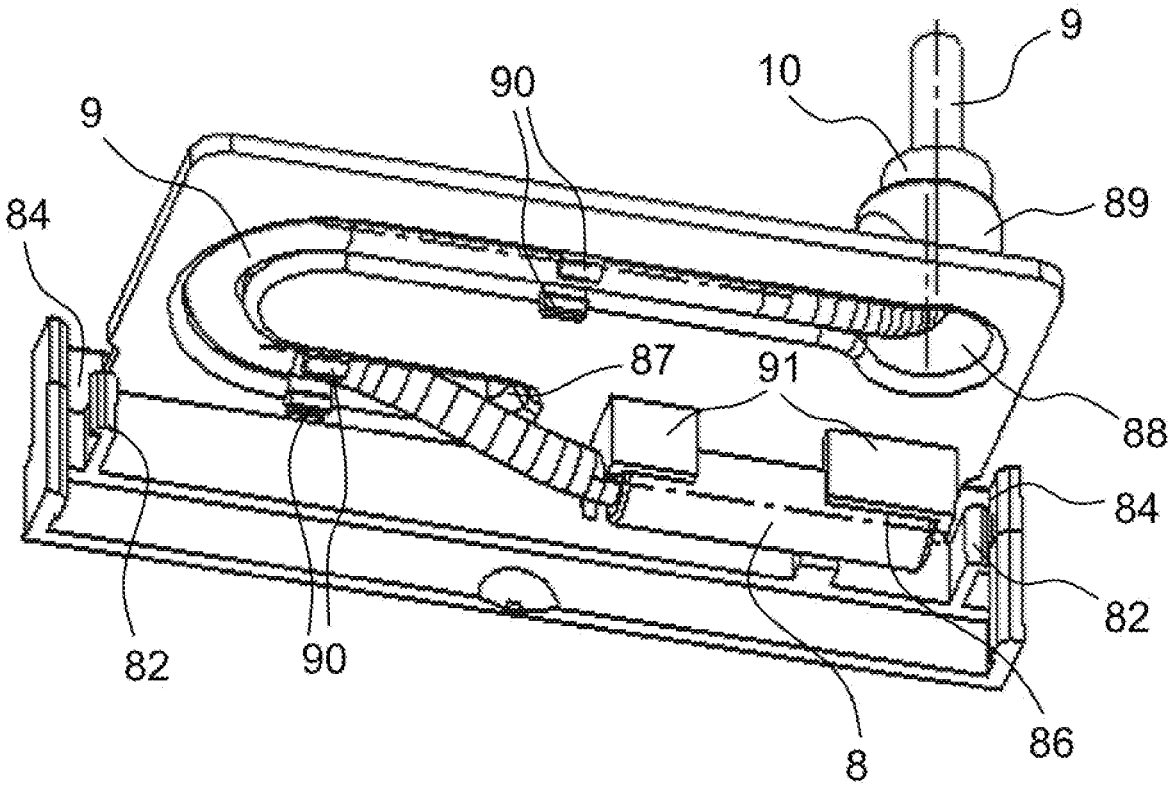
FIG. 8 is yet another representative, perspective view of the second duct housing part with a sensing member.

With reference to FIG. 4, in a possible embodiment, the air duct 71 is configured to have the first duct housing part 72, and an external second duct housing part 73. A sensing element 8, shown in FIG. 8, is provided on the second duct housing part 73. The second duct housing part 73 is configured to be selectively connected to the first duct housing part 72. The first duct housing part 72 has a portion provided in a substantially box-shaped manner. The second duct housing part 73 is a lateral wall of the box-shaped first duct housing part 72, when the second duct housing part 73 is connected to the first duct housing part 72. In a possible embodiment, the lateral wall is an upper wall 75, shown in FIG. 5, of the substantially box-shaped first duct housing part 72, which is in a plane perpendicular to the air suctioning entrance opening 74.

With reference to FIG. 4, the duct housing parts 72, 73 are configured to be connected to each other by a sliding movement of the second duct housing part 73 towards the first duct housing part 72. When the second duct housing part 73 is moved in a sliding direction s towards the first duct housing part 72, edge portions 81, shown in FIG. 6, of the second duct housing part 73 are guided by corresponding guiding grooves 78. The guiding grooves 78 are provided at opposite sides of the second duct housing part 73. Each of the guiding grooves 78 are defined with a first wall 79, and a second wall 80 spaced apart from the first wall 79. Stated in more detail, the guiding groove 78 is provided between the walls 79, 80. In a possible embodiment, the second duct housing part 73 includes at least one engagement member 82 for engaging with corresponding engagement members 83 of the first duct housing part 72, when the second duct housing part 73 is connected to the first duct housing part 72. In a possible embodiment, there are two mutual engagement members 82 and two corresponding engagement members 83. As can be seen in FIG. 4, the exemplary engagement members can be a flexible arm. The engagement members 82 can have a substantially L-shaped form. In more detail, the engagement members 82 have a first portion extending substantially parallel to the sliding direction s and a second portion extending substantially perpendicular to the sliding direction s. The second portion attaches to the corresponding engagement member 83 of the first duct housing part 72, when the second duct housing part 73 is connected to the first duct housing part 72. Before carrying out a foaming process of the body 2, which entails filling a gap between the inner liner 5 and the outer wall of the body 2 with an insulation element 12, shown in FIG. 5, the second duct housing part 73 is connected to the first duct housing part 72. The insulation element 12 prevents leakage of the cool air from the storage compartment 3.

Figure 5:
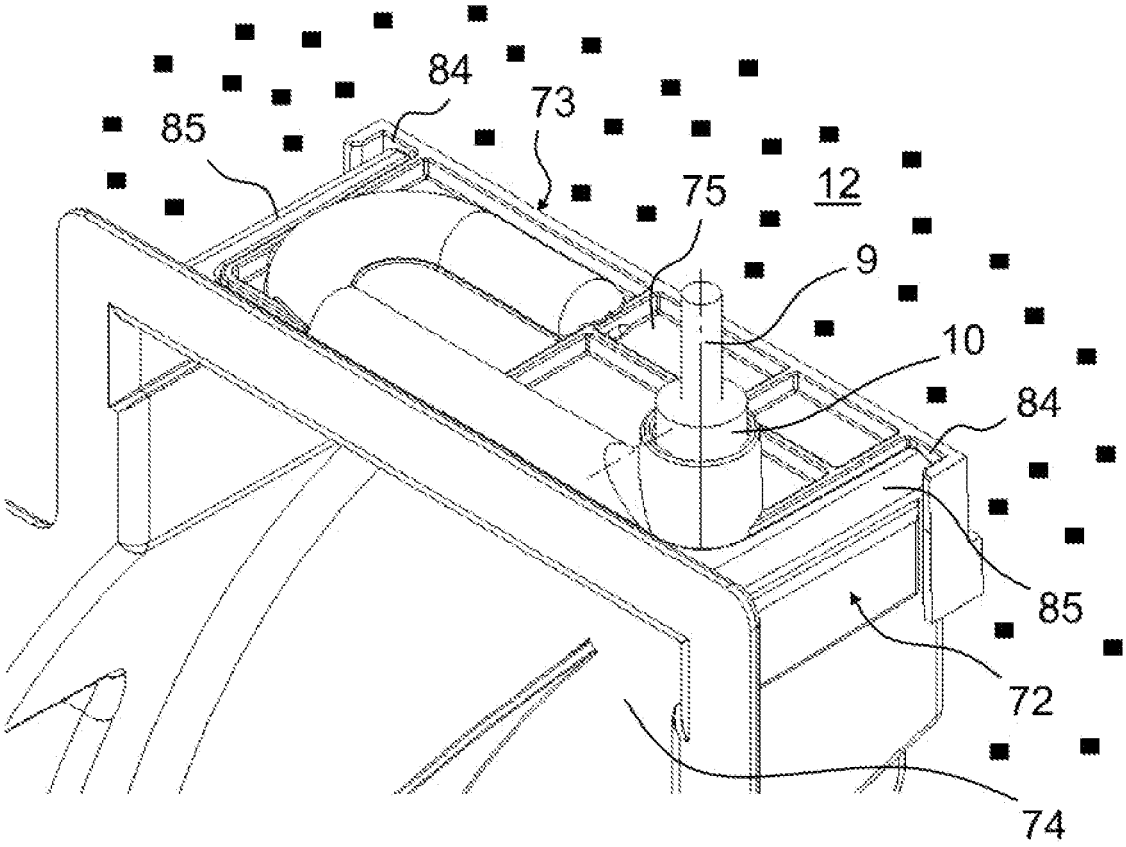
FIG. 5 is a representative, fragmentary, perspective view of the first duct housing part and second duct housing part in a mounted state.

As can be seen in FIG. 5, when the second duct housing part 73 is connected to the first duct housing part 72, the insulation element 12, such as a foam element, fills the gaps provided behind the inner liner 5. In order to prevent the leakage of the insulation element 12 from outside of the air duct assembly 7 to the inside of the air duct assembly 7, the second duct housing part 73 includes two mutual wall receiving portions 84 which at least partially receive the corresponding sidewalls 85 of the first duct housing part 72, when the second duct housing part 73 is connected to the first duct housing part 72. The wall receiving portions 84 are provided on a side of the second duct housing part 73 facing away from the inner liner 5. The wall receiving portions 84 are provided with a basically U-shaped cross-section. A portion of the U-shaped wall receiving portion 84 extends parallel to the sidewall 85 of the first duct housing part 72.

Figure 6:
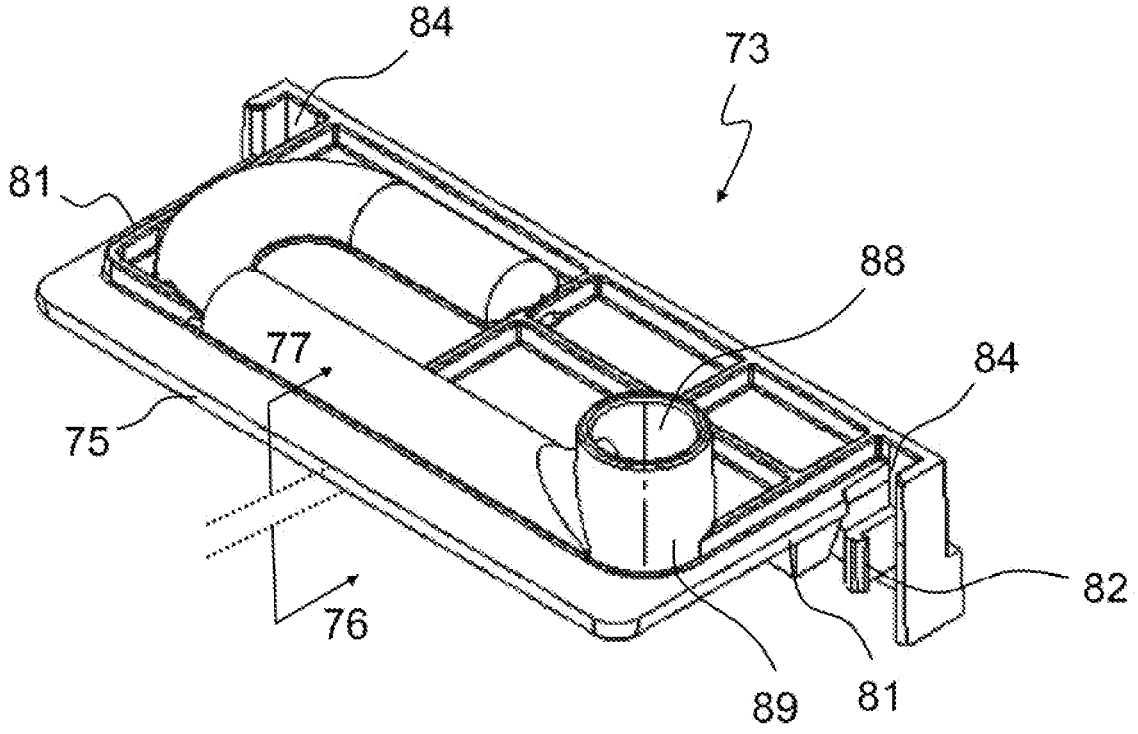
FIG. 6 is a representative, perspective view of the second duct housing part.

With reference to FIG. 6, the second duct housing part 73 includes a cable guiding hole 88 provided between the upper side 77 and lower side 76 of the second duct housing part 73. A circumferential wall 89 is provided on a circumference of the cable guiding hole 88 at the upper side 77 of the second duct housing part 73 which is opposite to the lower side 76, so as to extend away from the second duct housing part 73. In a possible embodiment, the circumferential wall 89 has a hollow cylindrical shape.

Figure 7:
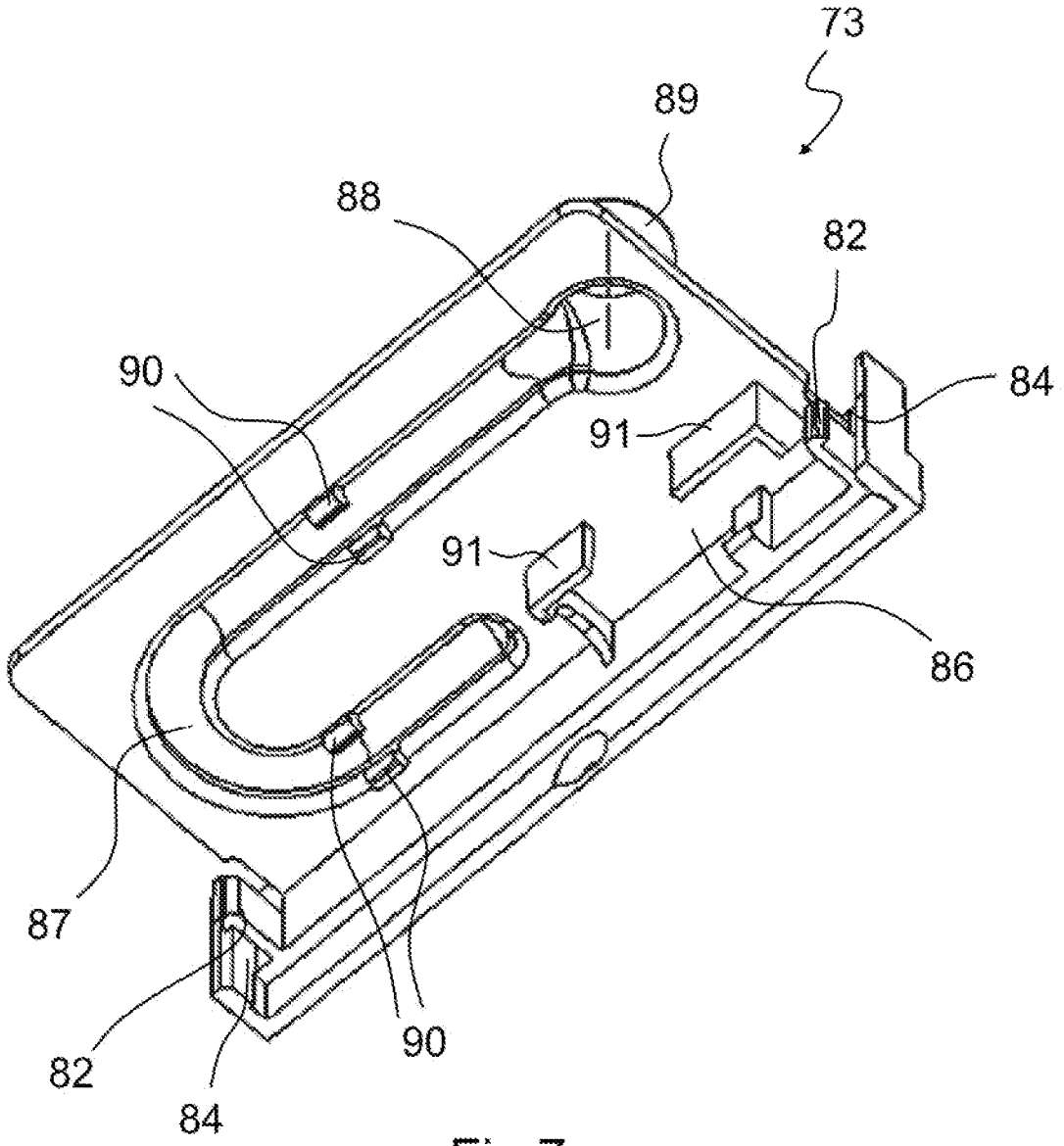
FIG. 7 is another representative, perspective view of the second duct housing part without a sensing member.

With reference to FIG. 7, in a possible embodiment, the second duct housing part 73 is configured to hold the sensing element 8 at the lower side 76 of the second duct housing part 73 facing inside the first duct housing part 72. The second duct housing part 73 includes a sensing element holding chamber 86 provided at the lower side 76 of the second duct housing part 73 so as to hold the sensing element 8 in a tight-fit manner. In order to hold the sensing element 8, the sensing element holding chamber 86 has one or more sidewalls 91 of the holding chamber 86 provided on a lower surface of the second duct housing part 73. Preferably, the sensing element holding chamber 86 has two substantially L-shaped sidewalls 91 of the holding chamber 86. A wall gap can be provided between the two L-shaped sidewalls 91 of the holding chamber 86. There is a cable guiding groove 87 shaped and sized with respect to a shape and pathway of a cable 9, shown in FIG. 4, of the sensing element 8. The cable guiding groove 87 is provided at the lower side 76 of the second duct housing part 73. In a possible embodiment, the cable guiding hole 88 is provided on an end of the cable guiding groove 87. The second duct housing part 73 includes at least a pair of cable holding members 90 for holding the cable at least partially inside the cable guiding groove 87.

With reference to FIG. 8, the sensing element 8 is positioned at least partially inside the sensing element holding chamber 86. The cable 9, which is electrically connected to the sensing element 8, follows the path of cable guiding groove 87. At an end of the cable guiding groove 87 the cable can pass through the cable guiding hole 88. A gap covering member 10, preferably a foam member, is provided so as to cover a gap between the cable 9 and the circumferential wall 89. The gap covering member 10 prevents the leakage of the insulation element 12 from outside of the air duct assembly 7 to the inside of the air duct assembly 7.

The following is a summary list of reference numerals and the corresponding structure used in the above description of the invention.

REFERENCE LIST 1. cooling appliance
2. body
3. storage compartment
4. front access opening
5. inner liner
6. rear wall
7. air duct assembly
   71. air duct
   72. first duct housing part
   73. second duct housing part
   74. air suctioning entrance opening
   75. upper wall
   76. lower side
   77. upper side
   78. guiding groove

79. first wall
80. second wall
81. edge portion
82. engagement member
83. corresponding engagement member
84. wall receiving portion
85. sidewall
86. sensing element holding chamber
87. cable guiding groove
88. cable guiding hole
89. circumferential wall
90. cable holding member
91. sidewall of the holding chamber
8. sensing element
9. cable
10. gap covering member
11. cool air
12. insulation element
s. sliding direction

The invention claimed is:

1. A cooling appliance, comprising:

a storage compartment for receiving goods to be cooled;

an air duct assembly in fluid communication with said storage compartment, said air duct assembly including at least one air duct for suctioning cool air from said storage compartment;

said at least one air duct including a first duct housing part having an air suctioning entrance opening through which the cool air enters into said air duct, and an external second duct housing part configured to be selectively connected to said first duct housing part; and a sensing element for sensing a temperature of the cool air of said storage compartment, said sensing element being provided on said external second duct housing part.

2. The cooling appliance according to claim 1, wherein said first duct housing part is box-shaped, said second duct housing part defines a lateral wall of said box-shaped first duct housing part, and said second duct housing part is connected to said first duct housing part.

3. The cooling appliance according to claim 2, wherein said lateral wall is an upper wall of said box-shaped first duct housing part, and said lateral wall is in a plane perpendicular to said air suctioning entrance opening.

4. The cooling appliance according to claim 1, wherein said second duct housing part has a lower side facing an inside of said first duct housing part, and said second duct housing part is configured to hold said sensing element at said lower side.

5. The cooling appliance according to claim 1, wherein said first and second duct housing parts are configured to be connected to each other by a sliding movement of said second duct housing part towards said first duct housing part.

6. The cooling appliance according to claim 5, wherein said second duct housing part has edge portions, and said first duct housing part includes guiding grooves for guiding said edge portions.

7. The cooling appliance according to claim 6, wherein each of said guiding grooves is respectively defined by a first wall and a second wall spaced apart from said first wall.

8. The cooling appliance according to claim 1, wherein said first duct housing part has engagement members, and said second duct housing part has at least one engagement member for engaging with at least one of said engagement members of said first duct housing part, upon connecting said second duct housing part to said first duct housing part.

9. The cooling appliance according to claim 8, wherein said engagement members of said first duct housing part include two engagement members, and said at least one engagement member of said second duct housing part includes two engagement members.

10. The cooling appliance according to claim 1, wherein said second duct housing part includes wall receiving portions, and said first duct housing part includes sidewalls being at least partially received by said wall receiving portions, upon connecting said second duct housing part to said first duct housing part.

11. The cooling appliance according to claim 4, wherein said second duct housing part includes a sensing element holding chamber, provided at said lower side of said second duct housing part, for holding said sensing element in a tight-fit manner.

12. The cooling appliance according to claim 4, wherein said sensing element has a cable, and said second duct housing part includes a cable guiding groove shaped and sized with respect to a shape and pathway of said cable, said cable guiding groove being provided at said lower side of said second duct housing part.

13. The cooling appliance according to claim 12, wherein said second duct housing part includes at least a pair of cable holding members for holding said cable at least partially inside said cable guiding groove.

14. The cooling appliance according to claim 12, wherein said second duct housing part has a cable guiding hole formed at an end of said cable guiding groove, and said cable guiding hole is configured to allow said cable to pass through.

15. The cooling appliance according to claim 14, wherein:

said second duct housing part has an upper side disposed opposite to said lower side of said second duct housing part;

a circumferential wall is provided at a periphery of said cable guiding hole at said upper side of said second duct housing part;

said circumferential wall extends away from said second duct housing part; and a gap covering member covers a gap between said cable and said circumferential wall.

16. The cooling appliance according to claim 15, wherein said gap covering member is a foam member.

* * * * *